US011837169B2

(12) United States Patent
Chen et al.

(10) Patent No.: US 11,837,169 B2
(45) Date of Patent: Dec. 5, 2023

(54) PIXEL CIRCUIT, DISPLAY SUBSTRATE AND DISPLAY APPARATUS

(71) Applicant: BOE TECHNOLOGY GROUP CO., LTD., Beijing (CN)

(72) Inventors: Yipeng Chen, Beijing (CN); Libin Liu, Beijing (CN); Lujiang Huangfu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/744,709

(22) Filed: May 15, 2022

(65) Prior Publication Data

US 2022/0277693 A1 Sep. 1, 2022

Related U.S. Application Data

(63) Continuation of application No. 17/043,071, filed as application No. PCT/CN2020/076382 on Feb. 24, 2020, now Pat. No. 11,335,269.

(30) Foreign Application Priority Data

Mar. 1, 2019 (CN) ..... 201910156069.6

(51) Int. Cl.
*G09G 3/3258* (2016.01)
*G09G 3/20* (2006.01)
(Continued)

(52) U.S. Cl.
CPC ..... *G09G 3/3258* (2013.01); *G09G 3/2092* (2013.01); *G09G 3/3291* (2013.01);
(Continued)

(58) Field of Classification Search
CPC .. G09G 3/3258; G09G 3/2092; G09G 3/3291; G09G 3/3233; G09G 3/3241;
(Continued)

(56) References Cited

U.S. PATENT DOCUMENTS 11,335,269 B2 * 5/2022 Chen ..... G09G 3/3258
2012/0293478 A1 * 11/2012 Chaji ..... G09G 3/3266 345/212

(Continued)

FOREIGN PATENT DOCUMENTS

CN 103646629 A 3/2014
CN 203616972 U 5/2014

(Continued)

OTHER PUBLICATIONS

China Patent Office, CN201910156069.6 First Office Action dated Feb. 3, 2020 and the English translation thereof.

(Continued)

*Primary Examiner* — Tom V Sheng
(74) *Attorney, Agent, or Firm* — HOUTTEMAN LAW LLC

(57) ABSTRACT

The present disclosure provides a pixel circuit including: a driving transistor and a voltage control circuit; wherein in the voltage control circuit, at least one transistor directly coupled to a gate of the driving transistor is an oxide thin film transistor. The disclosure also provides a display substrate and a display apparatus.

10 Claims, 3 Drawing Sheets

(51) Int. Cl.
*G09G 3/3291* (2016.01)
*G09G 3/3233* (2016.01)

(52) U.S. Cl.
CPC ... *G09G 3/3233* (2013.01); *G09G 2300/0819* (2013.01); *G09G 2320/045* (2013.01)

(58) Field of Classification Search
CPC ..... G09G 3/325; G09G 2300/0809; G09G 2320/045; G09G 2300/0819
USPC ..... 345/76
See application file for complete search history.

(56) References Cited

U.S. PATENT DOCUMENTS

2013/0201173 A1* 8/2013 Chaji ..... G09G 3/3233 345/82
2014/0062993 A1* 3/2014 Chaji ..... G09G 3/3233 345/212
2014/0084932 A1* 3/2014 Chaji ..... G09G 3/006 324/414
2014/0225883 A1* 8/2014 Chaji ..... G09G 3/325 345/212
2014/0285407 A1* 9/2014 Chaji ..... G09G 3/3241 345/76
2014/0340432 A1* 11/2014 Chaji ..... G09G 3/3258 345/77
2015/0243203 A1 8/2015 Kim et al.
2015/0243720 A1* 8/2015 Kwon ..... H01L 27/1251 257/40
2016/0063921 A1* 3/2016 Tsai ..... G09G 3/3233 345/76
2016/0063922 A1* 3/2016 Tsai ..... G09G 3/3233 345/76
2016/0240565 A1 8/2016 Kim et al.
2017/0018226 A1* 1/2017 Yang ..... G09G 3/3233
2017/0329189 A1* 11/2017 Kim ..... H10K 10/482
2018/0005575 A1 1/2018 Lee et al.
2018/0013085 A1* 1/2018 Shin ..... G09G 3/3291
2018/0315374 A1* 11/2018 Zhang ..... G09G 3/3208
2019/0103055 A1* 4/2019 Gao ..... G09G 3/3233
2019/0130842 A1* 5/2019 Jang ..... G09G 3/3266
2019/0130847 A1* 5/2019 Um ..... G09G 3/3266
2019/0179467 A1* 6/2019 Kim ..... G06F 3/044
2019/0189055 A1* 6/2019 Zhang ..... H10K 59/00
2019/0214447 A1* 7/2019 Kim ..... H10K 59/1216
2019/0304367 A1* 10/2019 Li ..... G09G 3/3291
2020/0075641 A1 3/2020 Park et al.
2020/0184893 A1* 6/2020 Dong ..... G09G 3/3258
2020/0243635 A1 7/2020 Lee et al.
2020/0286432 A1* 9/2020 Zhang ..... G09G 3/3266
2020/0342808 A1* 10/2020 Han ..... G09G 3/3266
2021/0383752 A1* 12/2021 Yang ..... G09G 3/3233

FOREIGN PATENT DOCUMENTS

CN 105206221 A 12/2015
CN 106875894 A 6/2017
CN 107204173 A 9/2017
CN 107342048 A 11/2017
CN 107564468 A 1/2018
CN 107799062 A 3/2018
CN 108257561 A 7/2018
CN 108269537 A 7/2018
CN 108682386 A 10/2018
CN 109036288 A 12/2018
CN 109166907 A 1/2019
CN 109584799 A 4/2019
CN 109686314 A 4/2019
CN 110264946 A 9/2019

OTHER PUBLICATIONS

China Patent Office, CN201910156069.6 Second Office Action dated Sep. 3, 2020 and the English translation thereof.
WIPO, International Search Report dated Apr. 10, 2020 and the English translation thereof.
USPTO, U.S. Appl. No. 17/043,071 First Office Action dated Jul. 20, 2021.
USPTO, U.S. Appl. No. 17/043,071 Notice of Allowance dated Jan. 20, 2022.

* cited by examiner

PIXEL CIRCUIT, DISPLAY SUBSTRATE AND DISPLAY APPARATUS

CROSS-REFERENCE TO RELATED APPLICATION

This is a continuation application of U.S. patent application Ser. No. 17/043,071, filed on Sep. 29, 2020, a National Phase Application filed under 35 U.S.C. 371 as a national stage of PCT/CN2020/076382 filed on Feb. 24, 2020, an application claiming the benefit to Chinese Application No. 201910156069.6, filed on Mar. 1, 2019, the content of each of which is hereby incorporated by reference in its entirety.

The present application claims the priority of the Chinese Patent Application No. 201910156069.6, filed on Mar. 1, 2019, the disclosure of which is incorporated herein by reference in its entirety.

TECHNICAL FIELD

The present application relates to the field of display technology, and in particular to a pixel circuit, a display substrate, and a display apparatus.

BACKGROUND

An active matrix driving organic light emitting diode (AMOLED) display has advantages of a low manufacturing cost, a fast response, low power consumption, easy driving, a wide application range and the like, and is widely applied in the technical field of display.

The AMOLED display includes a plurality of pixel units arranged in an array, each pixel unit includes: a pixel circuit and an OLED (organic light emitting diode), the pixel circuit is used for driving the OLED to emit light. Specifically, the pixel circuit generally includes two basic components: a driving transistor (DTFT) supplying a driving current to the OLED; and a voltage control circuit controlling a driving operation of the DTFT.

SUMMARY

The present disclosure provides a pixel circuit, a display substrate and a display apparatus.

In a first aspect, an embodiment of the present disclosure provides a pixel circuit, including: a driving transistor and a voltage control circuit. In the voltage control circuit, at least one transistor directly coupled to a gate of the driving transistor is an oxide thin film transistor.

In some embodiments, a first electrode of the driving transistor is coupled to a first power supply terminal, a second electrode of the driving transistor is coupled to a first terminal of the light emitting device, and a gate of the driving transistor is coupled to the voltage control circuit;

the voltage control circuit is at least coupled to a corresponding gate line and a corresponding data line and is used for writing an electric signal into the gate of the driving transistor so as to control a gate voltage of the driving transistor.

In some embodiments, the voltage control circuit includes a switching transistor and a first capacitor;

a control electrode of the switching transistor is coupled to the gate line, a first electrode of the switching transistor is coupled to the data line, and a second electrode of the switching transistor is coupled to the gate of the driving transistor;

a first terminal of the first capacitor is coupled to the gate of the driving transistor, and a second terminal of the first capacitor is coupled to the first terminal of the light emitting device;

the switching transistor is the oxide thin film transistor.

In some embodiments, the voltage control circuit includes a first transistor, a second transistor, a third transistor, a fourth transistor, a fifth transistor, a sixth transistor and a second capacitor;

the second electrode of the driving transistor is coupled to the first terminal of the light emitting device through the sixth transistor;

a control electrode of the first transistor is coupled to a second control signal line, a first electrode of the first transistor is coupled to a second power supply terminal, and a second electrode of the first transistor is coupled to the gate of the driving transistor;

a control electrode of the second transistor is coupled to a third control signal line, a first electrode of the second transistor is coupled to the second electrode of the driving transistor, and a second electrode of the second transistor is coupled to the gate of the driving transistor;

a control electrode of the third transistor is coupled to the gate line, a first electrode of the third transistor is coupled to the data line, and a second electrode of the third transistor is coupled to a first terminal of the second capacitor;

a control electrode of the fourth transistor is coupled to a first control signal line, a first electrode of the fourth transistor is coupled to the second power supply terminal, and a second electrode of the fourth transistor is coupled to the first terminal of the second capacitor;

a control electrode of the fifth transistor is coupled to a fourth control signal line, a first electrode of the fifth transistor is coupled to the second power supply terminal, and a second electrode of the fifth transistor is coupled to the first terminal of the second capacitor;

a control electrode of the sixth transistor is coupled to the fourth control signal line, a first electrode of the sixth transistor is coupled to the second electrode of the driving transistor, and a second electrode of the sixth transistor is coupled to the first terminal of the light emitting device;

a second terminal of the second capacitor is coupled to the gate of the driving transistor;

at least one of the first transistor and the second transistor is the oxide thin film transistor.

In some embodiments, the voltage control circuit further includes a seventh transistor;

a control electrode of the seventh transistor is coupled to the first control signal line, a first electrode of the seventh transistor is coupled to the second power terminal, and a second electrode of the seventh transistor is coupled to the first terminal of the light emitting device.

In some embodiments, the voltage control circuit further includes an eighth transistor;

a control electrode of the eighth transistor is coupled to the gate line, a first electrode of the eighth transistor is floating, and a second electrode of the eighth transistor is coupled to the gate of the driving transistor.

In some embodiments, a material of an active layer in the oxide thin film transistor includes indium gallium zinc oxide.

In a second aspect, an embodiment of the present disclosure further provides a display substrate, including the pixel circuit as described above.

In a third aspect, an embodiment of the present disclosure further provides a display apparatus, including the display substrate as described above.

DETAILED DESCRIPTION

In order to make those skilled in the art better understand the technical solutions of the present disclosure, a pixel circuit, a display substrate, and a display apparatus provided in the present disclosure are described in further detail below with reference to the accompanying drawings.

The light emitting device in the present disclosure may be a current-driven light emitting device, such as an LED (Light Emitting Diode) or an OLED (Organic Light Emitting Diode), included in the related art, and the description is given by taking the light emitting device of an OLED as an example in the present embodiment.

In addition, the term "control electrode" mentioned in the present disclosure specifically refers to a gate (G) of a transistor, "a first electrode" specifically refers to a source (S) of a transistor, and the corresponding term "a second electrode" specifically refers to a drain (D) of a transistor. It is well known to those skilled in the art that a source and a drain of a transistor are functionally interchangeable, and when one of the two electrodes is used as the source, the other electrode is used as the drain, so "the first electrode" and "the second electrode" in this disclosure are interchangeable.

Figure 1:
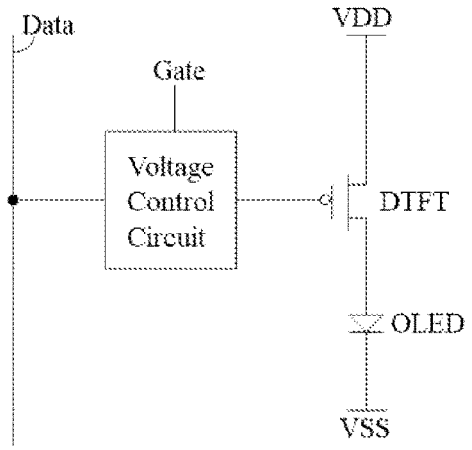
FIG. 1 is a schematic block diagram of a circuit structure of a pixel circuit according to an embodiment of the present disclosure.

FIG. 1 is a schematic block diagram of a circuit structure of a pixel circuit according to an embodiment of the present disclosure, and as shown in FIG. 1, the pixel circuit includes: a driving transistor DTFT and a voltage control circuit; a first electrode of the driving transistor DTFT is coupled to a first power supply terminal, a second electrode of the driving transistor DTFT is coupled to a first terminal (positive electrode) of a light emitting device OLED, a gate of the driving transistor DTFT is coupled to the voltage control circuit, and a second terminal (negative electrode) of the light emitting device OLED is coupled to a third power supply terminal.

In the present disclosure, an example in which the first power supply terminal supplies a high-level operating voltage VDD, and the third power supply terminal supplies a low-level operating voltage VSS is exemplarily described.

The voltage control circuit is coupled to at least a corresponding gate line Gate and a corresponding data line Data, and is used for outputting a writing electric signal serving as a control signal to the gate of the driving transistor DTFT so as to control a gate voltage of the driving transistor DTFT; in the voltage control circuit, at least one transistor directly coupled to the gate of the driving transistor DTFT is an oxide thin film transistor. An electron mobility of the oxide thin film transistor is relatively small (the electron mobility of the common low-temperature polysilicon thin film transistor (LTPS) is about 100 $cm^2/Vs$, while the electron mobility of the oxide thin film transistor is about 10 $cm^2/Vs$), and the off-state (off) leakage current (Ioff) thereof is small.

Note that the oxide thin film transistor is generally an N-type thin film transistor. As an alternative, a material of an active layer in the oxide thin film transistor includes: indium gallium zinc oxide (IGZO). Of course, the material of the active layer in the oxide thin film transistor in the present disclosure may also be any other oxide semiconductor, and is not be described in detail here.

When the pixel circuit operates in an output stage (the driving transistor DTFT drives the light emitting device OLED to emit light according to an output signal corresponding to a data of the data line Data of the voltage control circuit), a transistor in the voltage control circuit, which is directly coupled to the gate of the driving transistor DTFT, is in a turn-off state, so that the gate of the driving transistor DTFT is in a floating state, thereby ensuring that the driving transistor DTFT outputs a constant driving current.

However, since an off-state leakage current always exists in a transistor directly coupled to the gate of the driving transistor DTFT in a practical application, a voltage at the gate of the driving transistor DTFT may vary during the output stage, so that a driving current output by the driving transistor DTFT during the driving stage may vary, thereby affecting stability of light emission of the light emitting device OLED, and particularly, when a conventional thin film transistor (e.g., LTPS transistor) is used as a transistor (or referred to as a switching control transistor) directly coupled to the gate of the driving transistor DTFT, it is difficult to reduce the off-state leakage current of the LTPS transistor due to a high electron mobility of about 100 $cm^2/Vs$.

In the present disclosure, since the oxide thin film transistor with the electron mobility of only about 10 $cm^2/Vs$ is used, when the pixel circuit operates in the output stage, since the off-state leakage current of the oxide thin film transistor is small, the voltage change at the gate of the driving transistor DTFT is relatively small by a voltage generated by the discharge of the leakage current of the oxide thin film transistor, that is, the voltage change at the gate of the driving transistor DTFT is small in the output stage, and thus the change of the driving current output by the driving transistor DTFT is small, and the light emitting device OLED can stably emit light at this time.

Therefore, according to the technical solutions of the disclosure, at least one transistor in the voltage control circuit, which is directly coupled to the gate of the driving transistor DTFT, is the oxide thin film transistor, so that the voltage change at the gate of the driving transistor DTFT during the output stage can be effectively reduced, and thus the driving transistor DTFT can output a stable driving current to ensure stable light emission of the light emitting device OLED.

In the present disclosure, since the voltage change at the gate of the driving transistor DTFT is small during the output stage, the duration of the output stage can be extended appropriately, that is, the pixel circuit provided by the present disclosure can be adapted to a low frequency driving technology, and at this time, the power consumption of the pixel circuit can be greatly reduced.

Figure 2:
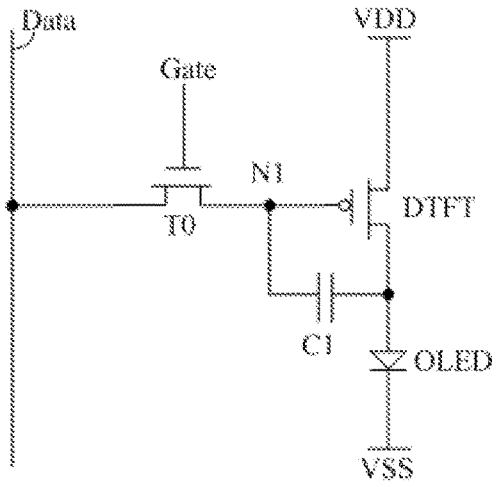
FIG. 2 is a schematic diagram of a circuit structure of another pixel circuit according to an embodiment of the disclosure.

FIG. 2 is a schematic diagram of a circuit structure of another pixel circuit provided in an embodiment of the present disclosure, and as shown in FIG. 2, the pixel circuit shown in FIG. 2 is an embodiment based on the pixel circuit shown in FIG. 1; wherein, the voltage control circuit includes: a switching transistor T0 and a first capacitor C1; a control electrode of the switching transistor T0 is coupled to the gate line Gate, a first electrode of the switching transistor T0 is coupled to the data line Data, and a second electrode of the switching transistor T0 is coupled to the gate of the driving transistor DTFT; a first terminal of the first capacitor C1 is coupled to the gate of the driving transistor DTFT, and a second terminal of the first capacitor C1 is coupled to the first terminal of the light emitting device OLED; at this time, the switching transistor T0 is a transistor directly coupled to the gate of the driving transistor DTFT, that is, the switching transistor T0 is the oxide thin film transistor.

In order to make those skilled in the art better understanding of the technical solutions of the present disclosure, the technical solutions of the present disclosure will be described in detail below with reference to the accompanying drawings. In the pixel circuit of 2T1C shown in FIG. 2, it is assumed that the driving transistor DTFT is a low-temperature polysilicon (LTPS) type thin film transistor, and the LTPS type transistor is a P-type transistor. The first power supply terminal supplies a high-level operating voltage VDD and the third power supply terminal supplies a low-level operating voltage VSS.

Figure 3:
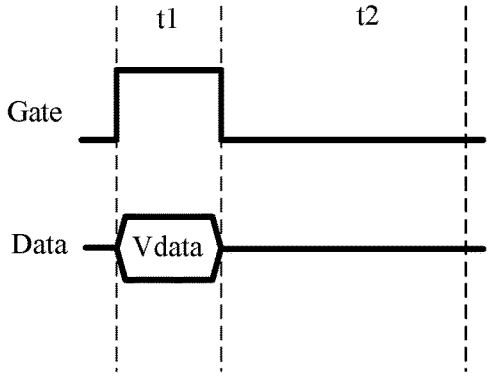
FIG. 3 is a timing diagram illustrating an operation of the pixel circuit shown in FIG. 2.

FIG. 3 is a timing diagram illustrating the operation of the pixel circuit shown in FIG. 2, and as shown in FIG. 3, the operation of the pixel circuit includes two stages: a data write stage t1 and an output stage t2.

In the data writing stage t1, a scan signal provided by the gate line Gate is in a high level state, at this time, the switching transistor T0 is turned on, the data signal in the data line Data is written to the gate of the driving transistor DTFT through the switching transistor T0, and the voltage at the gate of the driving transistor DTFT is Vdata (the capacitor C1 is charged to the voltage Vg=Vdata), that is, the voltage at the node N1 is Vdata. The gate-source voltage Vgs of the driving transistor DTFT is Vdata-Vdd.

In the output stage t2, the scan signal provided by the gate line Gate is in a low level state, at this time, the switching transistor T0 is turned off, and the gate (node N1) of the driving transistor DTFT is in a floating state, and due to voltage holding characteristics of the capacitor C1, the voltage at the gate of the driving transistor DTFT is maintained at Vdata after the switching transistor T0 is turned off, and the gate-source voltage Vgs of the driving transistor DTFT is Vdata-Vdd.

At this time, although the voltage at the node N1 is changed by the leakage current at the switching transistor T0, since the switching transistor T0 is the oxide thin film transistor and the off-state leakage current thereof is small, the voltage change amount (relating to the material and the channel width-to-length ratio of the switching transistor T0) at the node N1 caused by the leakage current is small, the gate-source voltage offset amount of the driving transistor DTFT is small, and the driving current output by the driving transistor DTFT is stable. In the whole output stage, the brightness of the light emitting device OLED does not change obviously, so that the display effect is ensured.

Figure 4:
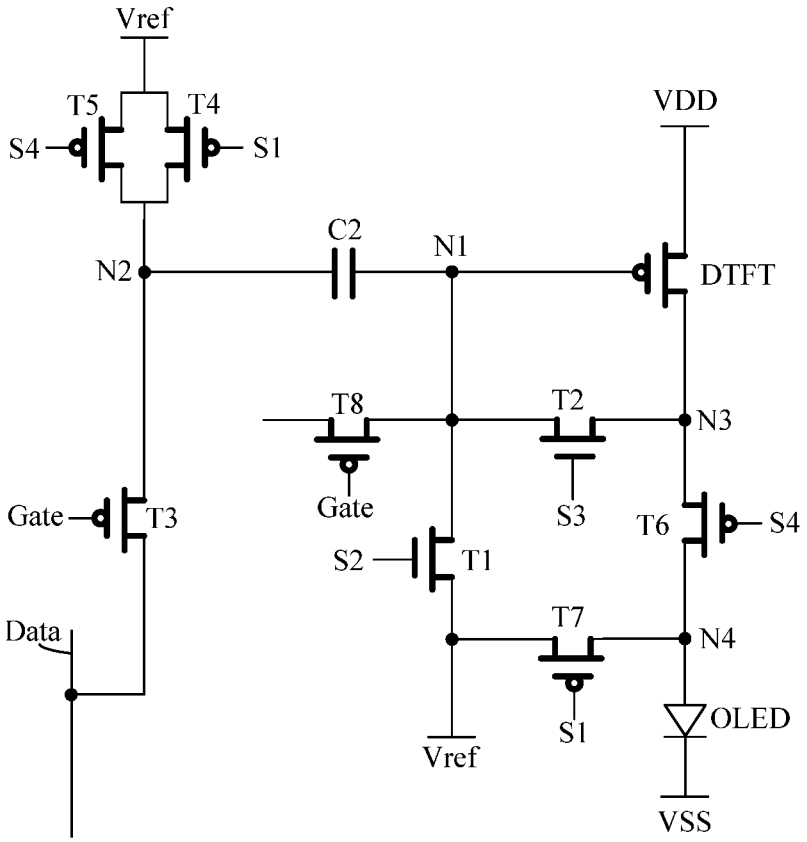
FIG. 4 is a schematic diagram of a circuit structure of another pixel circuit according to an embodiment of the disclosure.

FIG. 4 is a schematic diagram of a circuit structure of another pixel circuit provided in an embodiment of the present disclosure, and as shown in FIG. 4, the pixel circuit shown in FIG. 4 is an embodiment based on the pixel circuit shown in FIG. 1; wherein, the voltage control circuit includes: a first transistor T1, a second transistor T2, a third transistor T3, a fourth transistor T4, a fifth transistor T5, a sixth transistor T6, and a second capacitor C2; the second electrode of the driving transistor DTFT is coupled to the first terminal of the light emitting device OLED through the sixth transistor T6.

A control electrode of the first transistor T1 is coupled to a second control signal line S2, a first electrode of the first transistor T1 is coupled to the second power source terminal, and a second electrode of the first transistor T1 is coupled to the gate of the driving transistor DTFT.

A control electrode of the second transistor T2 is coupled to a third control signal line S3, a first electrode of the second transistor T2 is coupled to the second electrode of the driving transistor DTFT, and a second electrode of the second transistor T2 is coupled to the gate of the driving transistor DTFT.

A control electrode of the third transistor T3 is coupled to the gate line Gate, a first electrode of the third transistor T3 is coupled to the data line Data, and a second electrode of the third transistor T3 is coupled to a first terminal of the second capacitor C2.

A control electrode of the fourth transistor T4 is coupled to a first control signal line S1, a first electrode of the fourth transistor T4 is coupled to the second power source terminal, and a second electrode of the fourth transistor T4 is coupled to the first terminal of the second capacitor C2.

A control electrode of the fifth transistor T5 is coupled to a fourth control signal line S4, a first electrode of the fifth transistor T5 is coupled to the second power source terminal, and a second electrode of the fifth transistor T5 is coupled to the first terminal of the second capacitor C2.

A control electrode of the sixth transistor T6 is coupled to the fourth control signal line S4, a first electrode of the sixth transistor T6 is coupled to the second electrode of the driving transistor DTFT, and a second electrode of the sixth transistor T6 is coupled to the first terminal of the light emitting device OLED.

A second terminal of the second capacitor C2 is coupled to the gate of the driving transistor DTFT.

In the above circuit, the first transistor T1 and the second transistor T2 are directly coupled to the gate of the driving transistor DTFT and are capable of writing an electric signal to the gate of the driving transistor DTFT.

In the embodiment, at least one of the first transistor T1 and the second transistor T2 is the oxide thin film transistor, which can effectively reduce the voltage change at the gate of the driving transistor DTFT in the output stage.

Alternatively, the first transistor T1 and the second transistor T2 are both the oxide thin film transistors, and at this time, the amount of change in the voltage at the gate of the driving transistor DTFT in the output stage can be reduced as much as possible.

The above first to sixth transistors T1 to T6 may not only cooperate with each other to provide the gate of the driving transistor DTFT with a corresponding electrical signal, but also cooperate with each other to perform a threshold compensation on the driving transistor DTFT.

Optionally, the pixel circuit further includes: a seventh transistor T7; a control electrode of the seventh transistor T7 is coupled to the first control signal line S1, a first electrode of the seventh transistor T7 is coupled to the second power source terminal, and a second electrode of the seventh transistor T7 is coupled to the first terminal of the light emitting device OLED.

Optionally, the pixel circuit further includes: an eighth transistor T8; a control electrode of the eighth transistor T8 is coupled to the gate line Gate, a first electrode of the eighth transistor T8 is floating, and a second electrode of the eighth transistor T8 is coupled to the gate of the driving transistor DTFT.

The functions performed by the seventh transistor T7 and the eighth transistor T8 will be described in detail later.

In order to make those skilled in the art better understand the technical solutions of the present disclosure, the technical solutions of the present disclosure will be described in detail below with reference to the accompanying drawings. In the pixel circuit of 9T1C shown in FIG. 4, the third transistor T3 to the eighth transistor T8 and the driving transistor DTFT each are a low-temperature polysilicon (LTPS) thin film transistor, and the LTPS transistor is a P-type transistor. The first power supply terminal supplies a high-level operating voltage VDD, the second power supply terminal supplies a low-level reset voltage Vref, and the third power supply terminal supplies a low-level operating voltage VSS.

Figure 5:
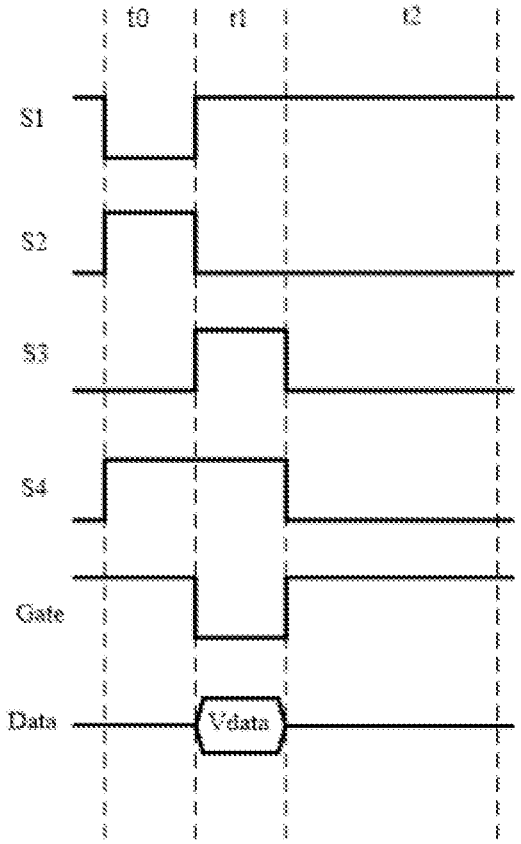
FIG. 5 is a timing diagram illustrating the operation of the pixel circuit shown in FIG. 4.

FIG. 5 is a timing diagram illustrating the operation of the pixel circuit shown in FIG. 4, and as shown in FIG. 5, the operation of the pixel circuit includes three stages: a reset stage t0, a data write and threshold compensation stage t1 and an output stage t2.

In the reset stage t0, a first control signal supplied by the first control signal line S1 is at a low level, a second control signal supplied by the second control signal line S2 is at a high level, a third control signal supplied by the third control signal line S3 is at a low level, a fourth control signal supplied by the fourth control signal line S4 is at a high level, and the scan signal supplied by the gate line Gate is at a high level. At this time, the first transistor T1, the fourth transistor T4, and the seventh transistor T7 are turned on, and the second transistor T2, the third transistor T3, the fifth transistor T5, the sixth transistor T6, and the eighth transistor T8 are turned off.

At this time, the reset voltage Vref is written to nodes N1, N2 and N4 through the first transistor T1, the fourth transistor T4 and the seventh transistor T7, respectively, so that the voltages at the nodes N1, N2 and N4 are reset, and a correct writing of the voltages in a subsequent operation process is guaranteed.

It should be noted that, in the present disclosure, by providing the seventh transistor T7, and writing the reset voltage Vref to the node N4 (the first terminal of the light emitting device OLED) in the reset stage, the voltage difference between the first terminal and the second terminal of the light emitting device OLED can be reduced, and the luminance of the light emitting device OLED can be reduced during a low gray scale display, so as to improve the contrast of the pixel.

In addition, since the voltage at the node N1 is a low level reset voltage Vref and the driving transistor DTFT is a P-type transistor, the driving transistor DTFT may be in an on state and output a driving current, but since the sixth transistor T6 is turned off, the driving current may not flow to the light emitting device OLED, and therefore the light emitting device OLED may not emit light by mistake.

In the data writing and threshold compensation stage t1, the first control signal provided by the first control signal line S1 is at a high level, the second control signal provided by the second control signal line S2 is at a low level, the third control signal provided by the third control signal line S3 is at a high level, the fourth control signal provided by the fourth control signal line S4 is at a high level, and the scan signal provided by the gate line Gate is at a low level. At this time, the second, third and eighth transistors T2, T3 and T8 are turned on, and the first, fourth, fifth, sixth and seventh transistors T1, T4, T5, T6 and T7 are turned off.

Since the second transistor T2 is turned on, the capacitor C2 can be charged by the driving current output by the driving transistor DTFT through the node N3, the second transistor T2 and the node N1, so that the voltage at the node N1 rises, until the voltage at the node N1 rises to VDD+Vth, the driving transistor DTFT is turned off, and the charging is ended, where Vth is a threshold voltage of the driving transistor DTFT, and Vth is negative.

Meanwhile, since the third transistor T3 is turned on, the data voltage Vdata can be written into the node N2 through the third transistor T3, and the voltage difference between the two terminals of the second capacitor C2 (the voltage difference between the second terminal and the first terminal) is VDD+Vth-Vdata.

In the output stage t2, the first control signal provided by the first control signal line S1 is at a high level, the second control signal provided by the second control signal line S2 is at a low level, the third control signal provided by the third control signal line S3 is at a low level, the fourth control signal provided by the fourth control signal line S4 is at a low level, and the scan signal provided by the gate line Gate is at a high level. At this time, the fifth transistor T5 and the sixth transistor T6 are turned on, and the first transistor T1, the second transistor T2, the third transistor T3, the fourth transistor T4, the seventh transistor T7, and the eighth transistor T8 are turned off.

Since the first transistor T1 and the second transistor T2 are turned off, the voltage holding characteristics of the capacitor C2 makes the gate of the driving transistor DTFT in a floating state (i.e., the node N1 is in a floating state).

Meanwhile, since the fifth transistor T5 is turned on, the reset voltage Vref is written to the node N2 through the fifth transistor T5, that is, the voltage at the node N2 changes from Vdata to Vref, and under the bootstrap action of the second capacitor C2, the voltage at the node N1 jumps to VDD+Vth+Vref-Vdata, and the gate-source voltage Vgs of the driving transistor DTFT is Vref+Vth-Vdata.

The saturated driving current of the driving transistor DTFT can be obtained as follows:

$$\begin{aligned} I &= K*(Vgs - Vth)^2 \\ &= K*(Vref + Vth - Vdata - Vth)^2 \\ &= K*(Vref - Vdata)^2 \end{aligned}$$

Where K is a constant related to the channel characteristics of the driving transistor DTFT. As can be seen from the above equation, the driving current outputted by the driving transistor DTFT during the output stage t2 is related to the reset voltage Vref and the data voltage Vdata, but is not related to the threshold voltage Vth of the driving transistor DTFT, so that the threshold compensation is realized.

During the output stage t2, since the off-state current of the first transistor T1 and the second transistor T2 is small, a large voltage offset at the node N1 can be effectively prevented, which can ensure that the driving transistor DTFT outputs a stable driving current.

In addition, at the beginning of the output stage t2, the signal in the third control signal line S3 to which the control electrode of the second transistor T2 is coupled changed from a high level to a low level, which causes the capacitor C2 to inject positive charges into the second transistor T2 via the node N1, thereby affecting the threshold-compensated voltage obtained at the node N1. To avoid the above problem, the eighth transistor T8 is provided in the present disclosure. The signal in the gate line Gate coupled to the control electrode of the eighth transistor T8 jumps from a low level to a high level at the beginning of the output stage, and the eighth transistor T8 releases its internal positive charges to the node N1, thereby compensating for the voltage change at the node N1 caused by the positive charges at the node N1 flowing into the second transistor T2. In the above process, the amount of positive charges at the node N1 flowing to the second transistor T2 is related to the electrical characteristics of the second transistor T2, and the amount of positive charges at the eighth transistor T8 flowing to the node N1 is related to the electrical characteristics of the eighth transistor T8, so that the amount of positive charges at the node N1 flowing to the second transistor T2 is equal to the amount of positive charges at the eighth transistor T8 flowing to the node N1 by setting the operation parameters of the second transistor T2 and the eighth transistor T8 reasonably, thereby ensuring that the voltage at the node N1 (i.e., the gate voltage of the driving transistor DTFT) remains substantially constant.

It should be noted that the specific pixel circuits shown in FIG. 2 and FIG. 4 are only used for exemplary purposes, and do not limit the technical solutions of the present disclosure; in the present disclosure, the voltage control circuit may alternatively adopt any other structure, which is not detailed herein again.

In addition, in the pixel circuits shown in FIG. 2 and FIG. 4, a case where all the transistors in the voltage control circuit that are directly coupled to the gate of the driving transistor are oxide thin film transistors is an embodiment in the present disclosure, which can reduce the amount of change in the voltage at the gate of the driving transistor DTFT in the output stage as much as possible to maintain a stable output of the driving transistor DTFT.

In addition, a case where transistors other than the transistor that is directly coupled to the gate of the driving transistor in the pixel circuit are low-temperature polysilicon thin film transistors is an embodiment of the present disclosure. The low-temperature polycrystalline silicon thin film transistor has high electron mobility (about 100 $cm^2/Vs$), and can be rapidly switched between an on state and an off state to ensure the response speed of the pixel circuit; meanwhile, the thin film transistor prepared based on the low-temperature polysilicon process is small in size, which is beneficial to the miniaturization of the pixel circuit, the aperture ratio of the pixel unit can be improved, and high resolution of a display apparatus can be achieved. Furthermore, the low-temperature polycrystalline silicon thin film transistor is a P-type low-temperature polycrystalline silicon thin film transistor, and the preparation process of the P-type low-temperature polycrystalline silicon thin film transistor is relatively simple and has a high yield. It should be understood by those skilled in the art that the low-temperature polysilicon thin film transistor in the present disclosure may also be an N-type low-temperature polysilicon thin film transistor.

It should be noted that when the pixel circuit includes both an oxide thin film transistor and a low-temperature polysilicon thin film transistor, a Low-temperature Polysilicon Oxide (LTPO) process may be used to prepare the pixel circuit, and the specific preparation process is not described in detail herein.

Embodiments of the present disclosure further provide a display substrate which includes a pixel circuit, and the pixel circuit may adopt the pixel circuit provided in any of the above embodiments, and the specific description can refer to the foregoing contents.

It should be noted that, when the pixel circuit in the display substrate operates in the output stage, an obvious voltage offset due to the leakage current will not occur at the gate of the driving transistor in the pixel circuit, so the pixel circuit is applicable to the low-frequency driving technology; therefore, when the display substrate is used for displaying a specific picture (such as a static picture), the low-frequency driving technology (such as 1 Hz low-frequency driving) can be adopted, so that the power consumption of the pixel unit can be reduced.

An embodiment of the present disclosure also provides a display apparatus, including: the display substrate adopts a display substrate provided by the above embodiments, and the specific description can refer to the foregoing contents.

It should be noted that the display apparatus in the present disclosure may be any product or component having a display function, such as an electronic paper, an OLED panel, a mobile phone, a tablet computer, a television, a display, a notebook computer, a digital photo frame, a navigator, and the like.

It will be understood that the above embodiments are merely exemplary embodiments employed to illustrate the principles of the present disclosure, and the present disclosure is not limited thereto. It will be apparent to those skilled in the art that various changes and modifications can be made therein without departing from the spirit and scope of the disclosure, and these changes and modifications are to be considered within the scope of the disclosure.

What is claimed is:

1. A pixel circuit, comprising: a driving transistor and a voltage control circuit; wherein in the voltage control circuit, at least one transistor directly coupled to a gate of the driving transistor is an oxide thin film transistor; and the gate of the driving transistor is configured to receive a reset voltage in a reset stage such that the driving transistor is in an ON state, and a high-level signal received by a first electrode of the driving transistor passes through the driving transistor and flows to a second electrode of the driving transistors;

wherein the first electrode of the driving transistor is coupled to a first power supply terminal from which the first electrode of the driving transistor receives the high-level signal in the reset stage, the second electrode of the driving transistor is coupled to a first terminal of a light emitting device, and the gate of the driving transistor is coupled to the voltage control circuit;

the voltage control circuit is at least coupled to a gate line and a data line, and is configured to write an electric signal into the gate of the driving transistor to control a gate voltage of the driving transistor such that the reset voltage is written to the gate of the driving transistor in the reset stage and the driving transistor is in the ON state; and wherein the voltage control circuit comprises: a first transistor, a second transistor, a third transistor, a fourth transistor, a fifth transistor, a sixth transistor and a second capacitor;

the second electrode of the driving transistor is coupled to the first terminal of the light emitting device through the sixth transistor;

a control electrode of the first transistor is coupled to a second control signal line, a first electrode of the first transistor is coupled to a second power supply terminal, and a second electrode of the first transistor is coupled to the gate of the driving transistor;

a control electrode of the second transistor is coupled to a third control signal line, a first electrode of the second transistor is coupled to the second electrode of the driving transistor, and a second electrode of the second transistor is coupled to the gate of the driving transistor;

a control electrode of the third transistor is coupled to the gate line, a first electrode of the third transistor is coupled to the data line, and a second electrode of the third transistor is coupled to a first terminal of the second capacitor;

a control electrode of the fourth transistor is coupled to a first control signal line, a first electrode of the fourth transistor is coupled to the second power supply terminal, and a second electrode of the fourth transistor is coupled to the first terminal of the second capacitor;

a control electrode of the fifth transistor is coupled to a fourth control signal line, a first electrode of the fifth transistor is coupled to the second power supply terminal, and a second electrode of the fifth transistor is coupled to the first terminal of the second capacitor;

a control electrode of the sixth transistor is coupled to the fourth control signal line, a first electrode of the sixth transistor is coupled to the second electrode of the driving transistor, and a second electrode of the sixth transistor is coupled to the first terminal of the light emitting device;

a second terminal of the second capacitor is coupled to the gate of the driving transistor; and at least one of the first transistor and the second transistor is the oxide thin film transistor.

2. The pixel circuit of claim 1, further comprising: a seventh transistor; wherein a control electrode of the seventh transistor is coupled to the first control signal line, a first electrode of the seventh transistor is coupled to the second power terminal, and a second electrode of the seventh transistor is coupled to the first terminal of the light emitting device.

3. The pixel circuit of claim 2, further comprising: an eighth transistor; wherein a control electrode of the eighth transistor is coupled to the gate line, a first electrode of the eighth transistor is floating, and a second electrode of the eighth transistor is coupled to the gate of the driving transistor.

4. The pixel circuit of claim 1, further comprising: an eighth transistor; wherein a control electrode of the eighth transistor is coupled to the gate line, a first electrode of the eighth transistor is floating, and a second electrode of the eighth transistor is coupled to the gate of the driving transistor.

5. The pixel circuit of claim 1, wherein a material of an active layer of the oxide thin film transistor comprises indium gallium zinc oxide.

6. A display substrate, comprising: the pixel circuit of claim 1.

7. The display substrate of claim 6, further comprising: a seventh transistor; wherein a control electrode of the seventh transistor is coupled to the first control signal line, a first electrode of the seventh transistor is coupled to the second power terminal, and a second electrode of the seventh transistor is coupled to the first terminal of the light emitting device.

8. The display substrate of claim 6, further comprising: an eighth transistor; wherein a control electrode of the eighth transistor is coupled to the gate line, a first electrode of the eighth transistor is floating, and a second electrode of the eighth transistor is coupled to the gate of the driving transistor.

9. The display substrate of claim 6, wherein a material of an active layer of the oxide thin film transistor comprises indium gallium zinc oxide.

10. A display apparatus, comprising: the display substrate of claim 6.

* * * * *